US006415732B1

(12) United States Patent
Delorenzo

(10) Patent No.: US 6,415,732 B1
(45) Date of Patent: Jul. 9, 2002

(54) MARINE LIGHTED GRAB RAIL

(76) Inventor: Leonard Delorenzo, 3691 NW. 20 St., Miami, FL (US) 33142

( * ) Notice: Subject to any disclaimer, the term of this patent is extended or adjusted under 35 U.S.C. 154(b) by 0 days.

(21) Appl. No.: 09/613,076

(22) Filed: Jul. 10, 2000

(51) Int. Cl.[7] ..... B63B 8/00
(52) U.S. Cl. ..... 114/343; 114/364; 362/477
(58) Field of Search ..... 114/343, 362, 114/364; 362/217, 477, 362, 372, 374, 375

(56) References Cited

U.S. PATENT DOCUMENTS

| | | | | | |
|---|---|---|---|---|---|
| 2,721,255 | A | * | 10/1955 | Lanmon | 362/146 |
| 3,057,991 | A | * | 10/1962 | Grenadier | 362/146 |
| 3,569,689 | A | * | 3/1971 | Nestrock | 362/146 |
| 4,161,769 | A | | 7/1979 | Elliott | |
| 4,274,127 | A | * | 6/1981 | Beck et al. | 362/72 |
| 4,515,393 | A | | 5/1985 | Sauter | |
| 5,025,352 | A | * | 6/1991 | Brown | 362/501 |
| 5,297,010 | A | * | 3/1994 | Camarota et al. | 362/501 |
| 5,339,225 | A | * | 8/1994 | Wiggerman | 362/477 |
| 5,396,740 | A | * | 3/1995 | Bocchi | 52/33 |
| 5,504,342 | A | | 4/1996 | Jaynes | |
| 5,779,228 | A | * | 7/1998 | Hansen | 256/65 |
| 5,913,671 | A | * | 6/1999 | Fernandez et al. | 43/18.1 |
| 6,065,852 | A | * | 5/2000 | Crumley | 362/146 |
| 6,135,621 | A | * | 10/2000 | Bach et al. | 362/399 |
| 6,174,078 | B1 | * | 1/2001 | Ohm et al. | 362/477 |
| 6,176,601 | B1 | * | 1/2001 | Nester | 362/477 |

* cited by examiner

*Primary Examiner*—S. Joseph Morano
*Assistant Examiner*—Ajay Vasudeva
(74) *Attorney, Agent, or Firm*—Laurence J. Edson; Ruben Y. Alcoba

(57) ABSTRACT

A marine lighted grab rail that is waterproof and direct current powered for use in a marine environment that produces an indirect light source. The rail portion is made of stainless steel tube that defines an aperture within the length of its structure. The stainless steel tube houses a waterproof transparent housing. A light source is housed inside the waterproof transparent housing, which is sealed, with a pair of plugs, at either end. Only the wires needed to carry electricity to the light source are allowed to exit the waterproof transparent housing's end. The stainless steel tube is mounted on mounting brackets after the above steps have been completed and the wires are connected to a direct current power source.

11 Claims, 3 Drawing Sheets

MARINE LIGHTED GRAB RAIL

BACKGROUND

It's hard to grab what you cannot see. Hence, grab rails on boats are illuminated at night. The current state of the art utilizes mounted dome lights to illuminate rails. However, mounted dome lights are far from ideal. Dome lights create excessive glare, which can blind passengers and compromise safety. Dome lights also expend more energy than self-illuminating grab rails. Finally, dome lights have limited aesthetic appeal. The art cries out for an alternative manner in which to guide users in gripping grab rails.

Designing illuminated grab rails for marine use presents several challenges. First, seawater can cause great damage. An illuminated grab rail must be impervious to water and resistant to corrosion. Furthermore, energy is at a premium aboard ship. A direct current powered light source is preferred. Finally, the ideal grab rail is multifunctional and allows versatility of application.

Rails that provide illumination have been the subjects of earlier patents. The prior art, discussed below, illustrates previous developments.

U.S. Pat. No. 5,504,342 to Jaynes et al. describes a handrail equipped with an ultraviolet bulb and is useful as an accessory in night fishing. The Jaynes handrail has a transparent cover that protects the bulb from the elements. However, the Jaynes patent does not teach the how to create a waterproof housing for the light source. Jaynes focuses on projecting the light directly out and away from the boat to induce fluorescence in the pigments used in ultraviolet fishing line.

U.S. Pat. No. 4,161,769 to Elliott describes an illuminated handrail constructed to inherently prevent entry of water. The Elliott handrail is constructed of stainless steel and uses fluorescent bulbs for illumination. As with the Jaynes patent, the Elliott patent does not teach a waterproof housing for the invention's light source.

U.S. Pat. No. 4,515,393 to Sauter describes a neon lighted roll bar. The Sauter roll bar incorporates neon light in a central portion of the overhead crossbar. The Sauter roll bar is not waterproof nor does it suggest marine use.

For the above reasons, there is a need for, a marine lighted grab rail that is waterproof and direct current powered that produces an indirect light source to illuminate its surroundings.

SUMMARY

The present invention is directed to an apparatus that satisfies the need of providing an indirect light source for handrails on a marine vessel that is waterproof and direct current powered. The apparatus comprises of a stainless steel tube that defines an aperture that runs most of the tube's length. The stainless steel tube is mounted on at least a pair of mounting brackets. A variety of mounting brackets may be used to mount the grab rail to the boat. The mounting bracket incorporates an aperture adjusting means that allows the stainless steel tube's aperture to be positioned at any angle, preferably towards the body supporting the brackets thereby reducing the normal glare produced by the current state of the art.

A water tube light assembly can be fabricated by performing the following steps. First, one acquires a tube light having a first and second ends. Then an electrical wire is connected to each end of the tube light. Next, the tube light and the electric wire assembly are placed inside a waterproof transparent housing. The waterproof housing has a first and second end. Finally, a sealent is injected into the waterproof transparent housing's ends after the unattached ends of the electric wires exit the waterproof transparent housing.

Prior to mounting the stainless steel tube to the mounting bracket, a waterproof tube light assembly would be housed inside of the stainless steel tube. The waterproof tube light assembly comprises of a light tube, at least a pair of wires, a pair of plugs and a waterproof transparent housing. The light tube is first attached to the wires, then the light tube and wire assembly are housed inside of the waterproof transparent housing and lastly the plugs are inserted at each end of the waterproof transparent housing. The plugs, preferably a sealant such as silicon, allow the ends of the wires not attached to the tube light to exit the waterproof transparent housing. The wires would lastly be connected to a direct current power source to make the invention operational.

Accordingly, it is a principle object of the invention to provide an illuminated grab rail with enhanced efficiency for both energy consumption and light dispersion.

It is another object of the invention to increase the visibility of a handrail by providing an indirect light source that would not produce a direct glare that is associated with dome light in marine environments.

It is another object of the invention to provide an illuminated grab rail with improved tolerance to the rigors of marine use. In other words, a grab rail that is impervious to water and resistant to corrosion.

It is a further object of the invention to provide a grab rail whose illumination effect may be modified via an easily repositioned aperture.

It is an object of the invention to provide improved elements and arrangements thereof in a grab rail for the purposes described which is inexpensive, durable, and fully effective in accomplishing its intended purposes.

These and other objects of the present invention will become readily apparent upon further review of the following specification and drawings.

DRAWINGS

These and other features, aspects, and advantages of the present invention will become better understood with regard to the following descriptions, appended claims, and accompanying drawings where:

DESCRIPTION

Figure 3:
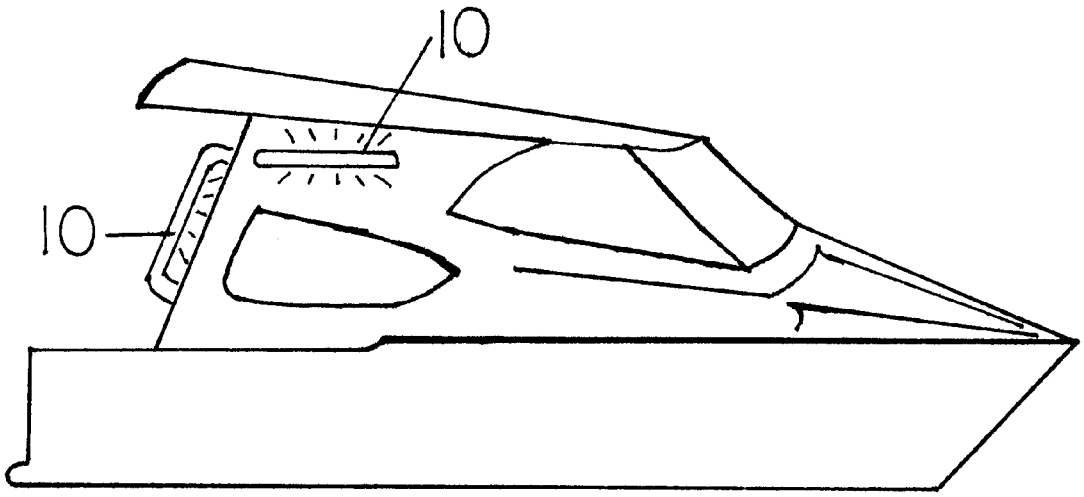
FIG. 3 is a side view of the handrail of the present invention shown mounted on a boat.

As shown in FIG. 3, the present invention is a marine lighted grab rail 10 that may be mounted on any surface of a boat that may lend itself to quick support should a boat unexpectedly tilt in any direction due to the unpredictable nature of open bodies of water. The marine lighted grab rail provides a means for support for passengers that have lost their balance due to the unforeseen tilting that occurs in open bodies of water while at the same time providing an indirect light source that helps illuminate the immediate surroundings of the marine lighted grab rail. The capacity to illuminate its surroundings is an essential feature of the marine lighted grab rail, for it allows imperiled boat occupants a means to locate the marine lighted grab rail with out being blinded by direct glare during night time operations or while occupants are occupying the interior of the boat under low visibility conditions.

Figure 1:
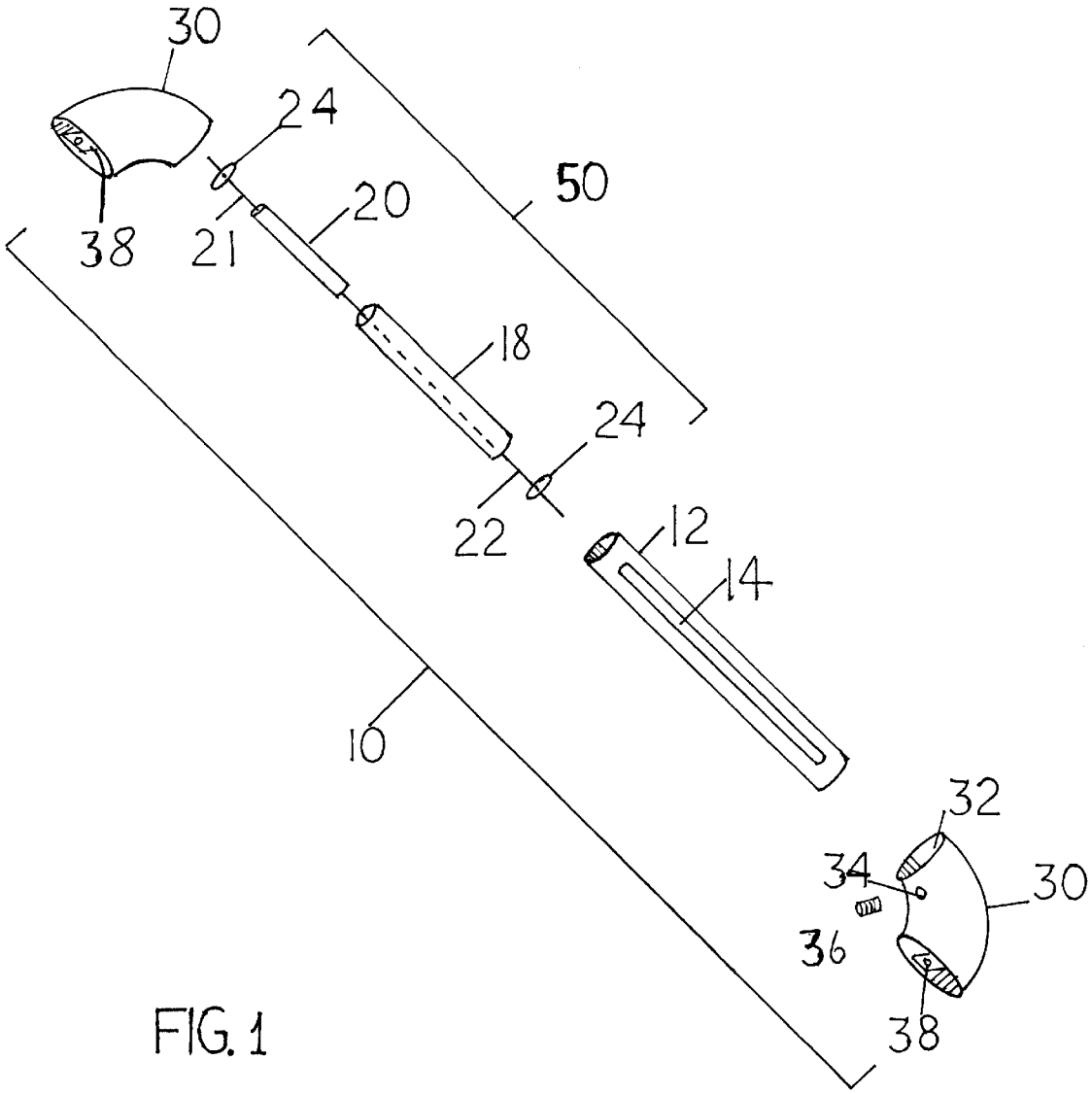
FIG. 1 is an exploded view of a marine-lighted grab rail.

FIG. 1 shows an embodiment of the marine lighted grab rail 10 in detail. The marine lighted grab rail 10 comprises of a stainless steel tube 12 that houses a waterproof tube light assembly 50 that is direct current powered and in which said stainless steel tube 12 is mounted on to at least a pair of mounting brackets 30 that are attached to a surface of a boat. Said mounting brackets 30 further comprising an aperture adjusting means located at a juncture wherein the stainless steel tube 12 and the mounting brackets 30 overlap.

The stainless steel tube 12 has an outside diameter of at least $\frac{7}{8}^{th}$ of an inch and said stainless steel tube 12 defines an aperture 14 of at least $\frac{1}{4}^{th}$ of an inch in width and in which said aperture 14 is centrally located within said stainless steel tube 12 and said aperture 14 runs parallel to the length of said stainless steel tube 12. The aperture 14 created within said stainless steel tube 12 has to be of a length and width that does not compromise the strength of said stainless steel tube 12.

The stainless steel tube 12 slips into an opening 32 of the mounting bracket 30. FIG. 1 only shows one mounting bracket, but in the preferred embodiment another mounting bracket receives the other end of the stainless steel tube 12. The mounting brackets 30 may be mounted to the surface of the boat by screws, bolts, rivets or other suitable attachment means. The aperture adjusting means comprises of an aperture adjusting screw 36 that is screwed into an aperture adjusting screw hole 34 defined within the mounting brackets 30.

Figure 2:
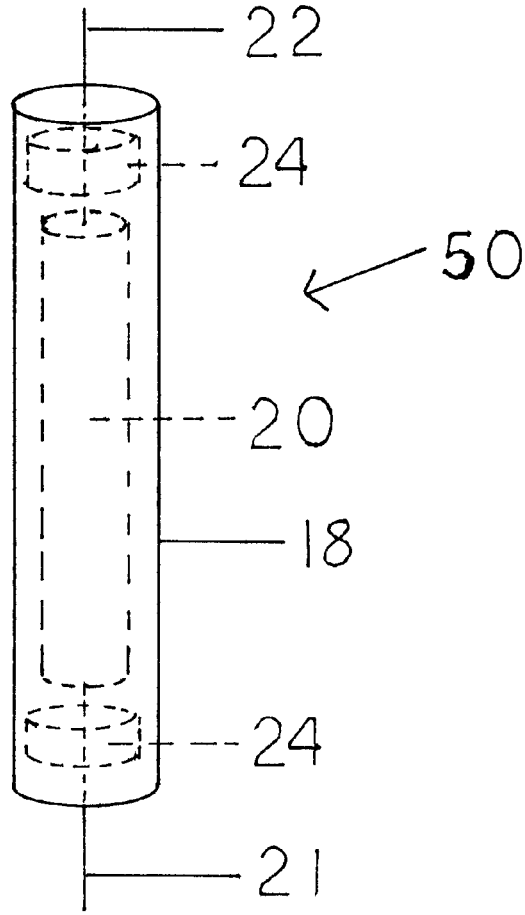
FIG. 2 is a detailed view of a tube-light assembly for use with the marine-lighted grab rail.

FIG. 2 shows the waterproof tube light assembly 50. The waterproof tube light assembly 50 is comprised of either a fluorescent or a neon tube light 20 that has a first end and a second end. At least an electrical wire 21,22 that is attached to each end of said tube light 20. After said fluorescent or neon tube light 20 and said electric wires 21,22 have been attached, the tube light and wire assembly is housed within said waterproof transparent housing 18 and then plugged by a pair of plugs 24, one plug 24 inserted on each side of said water proof transparent housing 18, and in which said plugs 24 allow said electric wires 21,22 to exit said waterproof transparent housing 18 while at the same time forming a seal that prevents the entry of water within the waterproof tube light assembly 50. The electric wires 21,22 that exit said waterproof transparent housing 18 attach to a direct current power source located within a marine vessel.

The waterproof transparent housing 18 may be made of a plastic or of a similar polymer. The waterproof transparent housing 18 may be colored so that the marine lighted grab rail 10 radiates colored light to its surroundings.

The electric wires 21,22 on each side of the tube light 20 can be a single electric wire or a two electric wires. For simplicity, the drawings only show one electric wire 21,22 on each side. If the tube light used is a neon tube light, only one electric wire would be used on each side. If the tube light used is a fluorescent tube light, two electric wires would be used on each side.

The plugs 24 can be a sealant made of silicon or a rubberized material. In the preferred embodiment, silicon is inserted at the ends of the waterproof transparent housing 18 after the fluorescent or neon tube light 20 and the electric wire assembly have been centered within said waterproof transparent housing 18 and said electric wires 21,22 exit said waterproof transparent housing 18.

In another embodiment of the invention, the stainless steel tube may define more than one aperture within said stainless steel tube but the apertures must run end to end and said apertures can not compromise the strength of said stainless steel tube. The embodiment may have two waterproof tube light assemblies running end to end within said stainless steel tube or a single waterproof tube light assembly housed within said stainless steel tube. The mounting and adjusting means employed in the preferred embodiment of the invention would be equally applied to this embodiment.

The embodiments of the invention are used as supporting means for imperiled boat occupants under low visibility conditions. The marine lighted grab rail allows itself to be quickly located, for it radiates indirect light that is non-blinding. In a marine environment, the non-blinding feature is an essential element for it prevents accidents that occur using the current art, dome lights. Dome lights produce a glare that can temporarily blind an imperiled boat occupant and thereby prevent the occupant from locating a grab rail in his/her time of need. The marine lighted grab rail is mounted on to sections of a boat that are accessible to boat occupants and positioned in said sections as to allow the boat occupants a means for support prior to an accident occurring. The marine lighted grab rail can also be used to illuminate warning, exit and other informative signs on a boat. In addition, the marine lighted grab rail can be used to produce an aesthetic effect to the background of the boat if a colored waterproof transparent housing is used.

The previously described versions of the present invention have many advantages, including the use of direct current as its power source, the corrosion resistance of the tube light assembly and the reduction of direct glare when illuminating safety features.

The present invention uses direct current to power the light source, the use of direct current has the following advantages; it reduces the chance of electrocution and it prevents the light source from heating the stainless steel tube to a temperature that can burn or sear a body that comes into contact with the stainless steel tube. In addition, the use of direct current to power the light source reduces energy consumption.

The construction of the waterproof tube light assembly reduces the corrosion that is associated when allowing the leads of the fluorescent or neon tube lights and the electrical wires connected to said tube lights to be exposed to oxidizing agents, such as a marine environment. The waterproof tube light assembly because of its inherent construction prolongs the life of the light source while at the same time producing a shatter proof housing. The housing of the waterproof tube light assembly eliminates the risk of having the tube light shatter and thereby reduces the dangers associated with the shattering of glass.

The current art uses domes to illuminate boat decks and some of the interior passages of boats. This invention reduces the glare associated with dome lights. The invention reduces the glare effect by positioning the aperture located on the stainless steel tube so that it reflects against the surface that the grab rail is mounted to. The marine lighted grab rail promotes the visibility of the grab rails with out the unwanted glare effects of the current art, thereby increasing the chances that a grab rail will be located in time of need.

It is to be understood that the present invention is not limited to the sole embodiments described above, but encompasses any and all embodiments within the scope of the following claims.

What is claimed is:

1. A marine lighted grab rail that produces an indirect light source comprising:

(a) a stainless steel tube wherein said stainless steel tube has at least an outside diameter of ⅞ of an inch and has an aperture of at least ¼ of an inch in width and in which said aperture is centrally located within said stainless steel tube and said aperture runs parallel to the length of said stainless steel tube, wherein said aperture is of a length and height that does not compromise the strength of said stainless steel tube;

(b) a waterproof tube light assembly that is direct current powered and which is housed inside of said stainless steel tube, the assembly comprising a tube light with a first and a second end, the tube light selected from the group consisting of neon or flourescent, at least an electrical wire attached to each end of said tube light, a waterproof transparent housing to house said tube light and said electrical wires inside of, and a pair of plugs, one plug being inserted at each end of said waterproof transparent housing after said tube light and said electrical wires have been housed inside of said waterproof transparent housing and said electrical wires exit said waterproof transparent housing; and (c) at least a pair of mounting brackets to mount said stainless steel tube onto.

2. The marine lighted grab rail of claim 1, wherein said waterproof transparent housing is colored.

3. The marine lighted grab rail of claim 1, wherein said plug is silicone.

4. The marine lighted grab rail of claim 1, further comprising an aperture adjusting means.

5. The marine lighted grab rail of claim 1, wherein said waterproof transparent housing is made of plastic.

6. A marine lighted grab rail that produces an indirect light source comprising:

(a) a waterproof tube light assembly that must be direct current powered, the assembly comprising a tube light with a first and a second end, the tube light selected from the group consisting of neon or flourescent, at least an electric wire attached to each end of said tube light, a waterproof transparent housing to house said tube light and said electric wires into, and a pair of plugs, one plug being inserted at each end of said waterproof transparent housing after said tube light and said electrical wires have been housed inside of said waterproof transparent housing and said electrical wires exit said waterproof transparent housing;

(b) a stainless steel tube in which said waterproof tube light assembly is placed inside of, wherein said stainless steel tube has at least an outside diameter of ⅞ of an inch and said stainless steel tube has a left and a right aperture that are at least ¼ of an inch in width and in which said apertures are centrally located within said stainless steel tube and said apertures runs end to end and are parallel to the length of said stainless steel tube, wherein said apertures are separated by a non-milled section of the body of said stainless steel tube and in which the width, the length or the separation between the apertures does not compromise the strength of said stainless steel tube; and (c) at least a pair of mounting brackets to mount said stainless steel tube onto.

7. The marine lighted rail of claim 6, wherein said waterproof transparent housing is colored.

8. The marine lighted grab rail of claim 6, wherein said plug is silicone.

9. The marine lighted grab rail of claim 6, further comprising an aperture adjusting means.

10. The marine lighted grab rail of claim 6, wherein said waterproof transparent housing is made of plastic.

11. A method of making a waterproof tube light assembly, comprising the steps of:

(a) acquiring a tube light that has a first end and a second end;

(b) attaching at least an electrical wire to each end of said tube light;

(c) placing the tube light and electric wire assembly inside of a waterproof transparent housing, the waterproof housing having a first end and a second end; and (e) injecting a sealant into the waterproof transparent housing's ends after said electric wires' ends not connected to the tube light exit the waterproof transparent housing.

* * * * *